United States Patent [19]

Voves et al.

[11] Patent Number: 4,913,264

[45] Date of Patent: Apr. 3, 1990

[54] STAIRWAY CHAIRLIFT MECHANISM

[75] Inventors: David R. Voves, Racine; John F. Prendergast, Sr., Franklin; Thomas J. Green, West Bend, all of Wis.

[73] Assignee: The Cheney Company, New Berlin, Wis.

[21] Appl. No.: 151,481

[22] Filed: Feb. 2, 1988

[51] Int. Cl.[4] ..... B66B 9/08

[52] U.S. Cl. ..... 187/12; 297/349; 248/425

[58] Field of Search ..... 187/10, 12, 13, 14; 297/252, 349; 248/425; 5/81 R

[56] References Cited

U.S. PATENT DOCUMENTS

| | | | |
|---|---|---|---|
| 2,845,990 | 8/1958 | Hubert | 297/349 X |
| 2,856,027 | 10/1958 | Schryver | 187/12 |
| 2,888,099 | 5/1959 | Hoffmann | 187/12 |
| 3,113,804 | 12/1963 | Ritter | 297/252 |
| 4,043,427 | 8/1977 | Ackerman | 187/12 |
| 4,417,715 | 11/1983 | Edwards | 248/425 |
| 4,564,086 | 1/1986 | Kingston | 187/12 |

FOREIGN PATENT DOCUMENTS

| | | | |
|---|---|---|---|
| 2701981 | 7/1978 | Fed. Rep. of Germany | 187/12 |
| 1073819 | 9/1954 | France | 248/425 |
| 713581 | 8/1954 | United Kingdom | 248/425 |
| 726422 | 3/1955 | United Kingdom | 248/425 |
| 739959 | 11/1955 | United Kingdom | 248/425 |
| 2103577A | 2/1980 | United Kingdom | 187/12 |

*Primary Examiner*—H. Grant Skaggs
*Assistant Examiner*—Kenneth DeRosa
*Attorney, Agent, or Firm*—Michael, Best & Friedrich

[57] ABSTRACT

A stairway chairlift for transporting passengers in ascending and descending directions along a stairway includes a rail mounted adjacent one stairway wall and further includes a motorized chair unit movable along the rail. A seat, for carrying the passenger, is mounted to the top of the chair unit, and a swivel mechanism permits the seat to be rotated around a vertical axis to facilitate movement of the passenger onto and off of the seat. To minimize interference with ordinary use of the stairway, the seat is pivotally mounted to a horizontal plate which moves inwardly or outwardly in response to rotation of the seat so as to maintain a substantially constant clearance between the seat and the stairway wall. To further reduce interference with ordinary use of the stairway, the seat can be folded upwardly, as can be a foot rest mounted adjacent the lower end of the chair unit. A pair of arms, having inwardly curved end portions, can be lowered to form a retaining barrier around the seat as a passenger is being transported, and can be raised to permit the passenger to leave the seat after such transportation has been completed.

23 Claims, 4 Drawing Sheets

STAIRWAY CHAIRLIFT MECHANISM

BACKGROUND OF THE INVENTION

This invention relates generally to stairway chairlift mechanisms for individually transporting passengers in ascending and descending directions along a stairway, and, more particularly, to seat mechanisms for use in such stairway chairlifts.

Over the years, a variety of mechanisms have been developed for increasing the mobility of people, such as those confined to wheelchairs, who have difficulty climbing up and down stairs. One of the most successful of these mechanisms has been the stairway chairlift which, in its most common form, comprises a rigid steel rail, mounted along a stairway, and a motorized chair unit adapted to ride along the rail. Typically, the rail is positioned adjacent a wall along the stairway, and the chair unit includes a passenger seat at its upper end on which the passenger sits. To avoid interference with ordinary use of the stairway, stairway chairlifts are preferably arranged to project outwardly from the stairway walls as little as possible.

To increase the ease with which a passenger of oftentimes limited mobility can move onto and off of the seat, prior stairway chairlifts have included pivotable seats arranged to rotate around a vertical axis. Such arrangements permit the passenger to rotate the seat so as to avoid having to approach or leave at an awkward angle when moving onto or off of the seat. In such prior arrangements, the seat merely rotates around the vertical axis which must be spaced sufficiently far from the stairway wall as to avoid interference with the wall during rotation. This, in turn, increases the distance by which the stairway chairlift must be spaced from the wall, increases the overall dimensions of the stairway chairlift, and runs counter to the general goal of minimizing overall interference with ordinary use of the stairway.

In the past, it has been contemplated that the users of stairway chairlifts would be people who, while unable to climb stairs with ease, nevertheless have some use of their legs and can walk short distances to climb onto or off of the chairlift seat. When wheelchair-bound people attempt to use such prior chairlifts, however, considerable difficulty can be encountered in moving between the wheelchair and the seat.

In view of the foregoing, it is a general object of the present invention to provide a new and improved stairway chairlift.

It is a further object of the present invention to provide a new and improved seat swivel mechanism for use with stairway chairlifts.

It is a still further object of the present invention to provide a seat swivel mechanism for stairway chairlifts wherein a pivoting seat feature is provided without a corresponding increase in the degree to which the stairway chairlift projects outwardly from the stairway wall.

It is a still further object of the present invention to provide an improved stairway chairlift which is adapted for convenient use by wheelchair-bound passengers.

SUMMARY OF THE INVENTION

The invention provides a seat swivel mechanism for stairway chairlifts of the type including a motorized chair unit movable along a stairway. The seat swivel mechanism comprises a seat having a rearward edge portion and means for pivotably mounting the seat to the motorized chair unit for pivoting movement around a substantially vertical axis between a first position, wherein the rearward edge portion of the seat is positioned adjacent and substantially parallel to the stairway wall, and a second position, wherein the rearward edge portion of the seat is positioned substantially transverse to the stairway wall. Means, responsive to pivoting movement of the seat around the substantially vertical axis, are provided for moving the seat outwardly away from the stairway wall in response to pivoting movement of the seat from the first position to the second position and for moving the seat inwardly toward the stairway wall in response to pivoting movement of the seat from the second position to the first position.

The invention also provides a stairway chairlift comprising a rail mounted along a stairway, a motorized chair unit movable along the rail, a substantially planar foot rest, and means for supporting the foot rest from the chair unit for pivoting movement between a lowered, substantially horizontal position, and a raised, substantially vertical position, the means for supporting the foot rest including a manually operable lever adjacent the seat whereby an operator in the seat can grip and move the lever, and linkage means operably connecting the manually operable lever to the foot rest to cause pivoting movement of the foot rest between the lowered position and the raised position in response to movement of the manually operable lever from a first position to a second position.

The invention also provides, in a stairway chairlift of the type including a motorized chair unit movable along a rail, a seat assembly adapted to be carried on the chair unit, the seat assembly comprising a seat including a substantially vertical back portion and a substantially horizontal portion, a pair of arms, and means engaging the seat for supporting the arms for pivoting movement between a lowered position, wherein the arms extend substantially horizontally from the back portion and parallel to the horizontal portion, and a raised position, wherein the arms extend substantially vertically from the back portion, and means for selectively locking the arms in the raised position.

The invention also provides, in a stairway chairlift of the type including a motorized chair unit movable along a stairway, a seat assembly adapted to be carried on the chair unit, the seat assembly comprising a seat including a substantially vertical back portion and a substantially horizontal portion, and a pair of curved arms forming a passive passenger restraint substantially around and above the horizontal portion of the seat.

In one embodiment, the seat swivel mechanism functions to provide a substantially constant minimum clearance between the seat and the stairway wall as the seat rotates around the vertical axis.

In one embodiment, both the foot rest and the forward portion of the seat can be folded upwardly so as to minimize interference of the stairway chairlift with ordinary use of the stairway.

In one embodiment, either of the arms can be selectively locked in a vertical position to provide a rigid support for assisting a passenger in moving onto and off of the seat.

In one embodiment, the seat includes a pair of curved arms which form a passenger restraining barrier around the seat when the stairway chairlift is in use.

It is a principal feature of the present invention to provide a stairway chairlift wherein a seat is pivotally movable around a vertical axis which moves inwardly and outwardly relative to a stairway wall so as to maintain a substantially constant, minimum clearance between the seat and the wall as the seat rotates around the vertical axis.

It is another principal feature of the present invention to provide a stairway chairlift wherein the portions of a motorized chair unit that extend farthest into the stairway can be folded upwardly so as to avoid interference with ordinary use of the stairway when the stairway chairlift is standing idle.

It is another principal feature of the present invention to provide a stairway chairlift having arms which can be lowered to form a passenger restraining barrier around the seat, raised to permit egress from the seat, and which can be locked in a vertical position to provide support for a passenger moving onto or off of the seat.

It is another principal feature of the present invention to provide a stairway chairlift having a raisable foot platform which can be raised independently of the seat to avoid interference with a wheelchair-bound passenger moving onto or off of the seat.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 2:
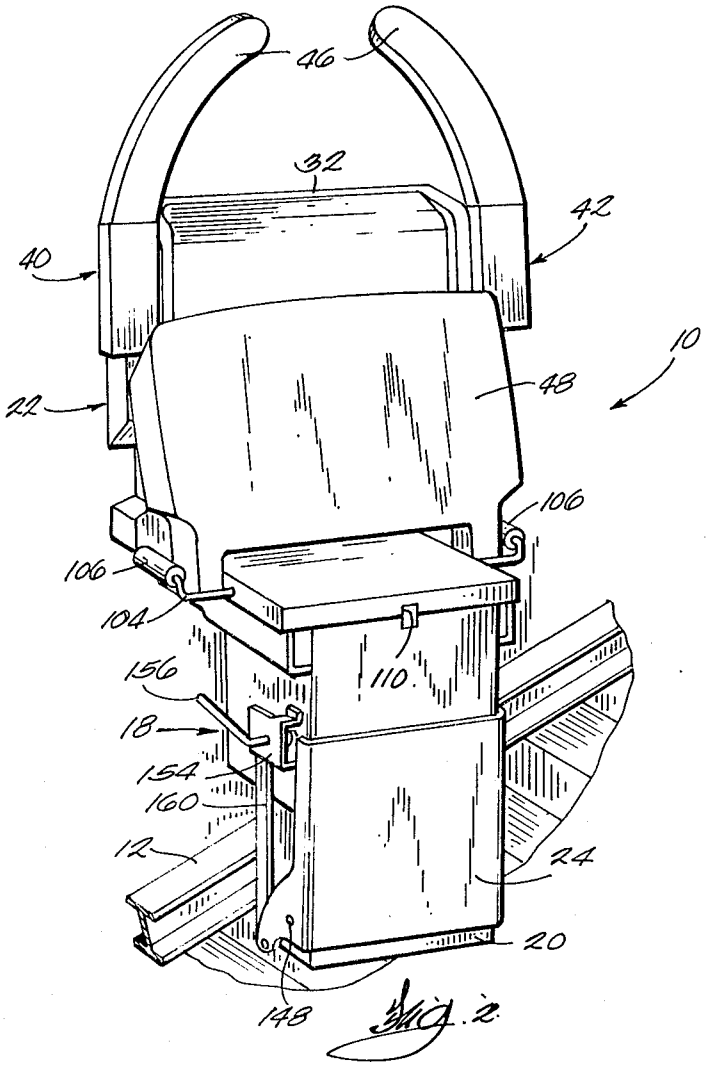
FIG. 2 is a front perspective view of the stairway chairlift illustrated in FIG. 1 shown in a folded position.
Figure 1:
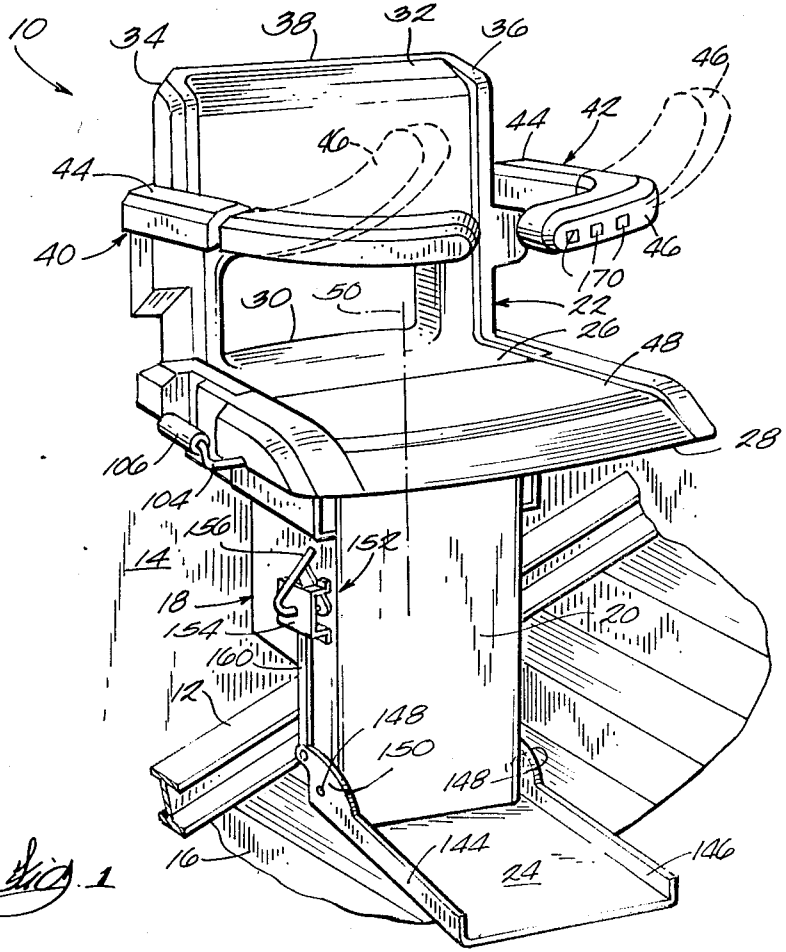
FIG. 1 is a front perspective view of a stairway chairlift system embodying various features of the invention.

A stairway chairlift system 10 embodying various features of the invention is illustrated in the drawings. As best illustrated in FIGS. 1 and 2, the stairway chairlift system 10 generally comprises a rigid rail 12 mounted adjacent a wall 14 along a stairway 16 and further comprises a motorized chair unit 18 movable along the rail 12 in ascending and descending directions along the stairway 16. The rail 12 preferably comprises a length of steel track having a substantially I-shaped cross section, and the chair unit 18 includes a lower housing 20 adapted to move along the rail. An electric motor, contained within the lower housing 20, drives a pinion (not shown) which engages a plurality of teeth (not shown) formed along the backside of the rail 12 to drive the chair unit 18 in either direction along the rail 12.

As further illustrated in FIGS. 1 and 2, a passenger seat 22 is mounted to the upper end of the lower housing 20, and a generally planar foot rest 24, for supporting a passenger's feet during transport along the stairway 16, is mounted adjacent the lowermost end of the lower housing 20. The passenger seat 22 includes a substantially horizontal portion 26 having forward and rearward edges 28 and 30, and further includes a generally vertical back portion or seat-back 32 extending upwardly from the rearward edge 30 of the horizontal portion 26. Preferably, the seat-back 32 is curved, as shown, so that the vertical side edges 34 and 36 of the seat-back 32 are spaced farther from the wall 14 than is the center portion 38 of the seat-back 32 when the passenger seat 22 is in the position illustrated in FIG. 1.

As further illustrated, the passenger seat 22 includes a pair of arms 40 and 42 which extend horizontally forwardly from the back portion 32 of the seat 22 over, and substantially parallel to, the horizontal portion 26 of the seat 22. In accordance with one aspect of the invention, the arms 40 and 42 curve inwardly toward each other, as shown, so as to form a passenger restraining barrier around and above the horizontal portion of the seat. In addition, each of the arms 40 and 42 includes a first or rearward portion 44 adapted to be pivotally connected, at one end, to the side edge 34 or 36 cf the seat-back 32, and a second or forward portion 46 extending from the remaining end of the rearward portion 44 and supported for pivotal movement substantially around the longitudinal axis of the first or rearward portion 44. This permits the forward portion 46 of each arm 40 or 42 to be rotated so as to lie in a substantially horizontal plane, as indicated in solid in FIG. 1, or in a substantially vertical plane as illustrated in phantom in FIG. 1. In addition, each of the arms 40 and 42 can be pivoted relative to the seat-back 32 so as to lie in a substantially horizontal position, as shown in FIG. 1, or a substantially vertical position as shown in FIG. 2.

To minimize interference with ordinary use of the stairway 16 when the stairway chairlift 10 is standing idle, the motorized chair unit 18 can be folded, as shown in FIG. 2, so as to reduce the overall extent by which the motorized chair unit 18 extends outwardly from the stairway wall 14 and into the path of the stairway 16. In particular, the passenger restraining arms 40 and 42 can be folded, as previously described, to an upright position, and the horizontal portion 26 of the passenger seat 22 includes a forward section 48 which is mounted for pivoting movement around a generally horizontal axis extending across the width of the seat 22 and which can be raised to a substantially vertical position as shown in FIG. 2. In addition, the foot rest 24 is mounted to the lower housing 20 of the chair unit 18 for pivoting movement between a lowered, horizontal position shown in FIG. 1 and a raised, substantially vertical position shown in FIG. 2. When folded, the overall thickness, and, thus, the extent to which the chair unit 18 extends into the stairway, is substantially the thickness of the lower housing 20.

Preferably, the passenger seat 22 includes an internal frame assembly formed of rigid structural members, such as steel tubing and channel as illustrated in FIGS. 3–11, and further includes an exterior sheath formed of molded plastic or similar resilient, decorative material, overlying the rigid internal framework so as to contour and pad the passenger seat 22 for maximum passenger comfort.

To further the ease with which an oftentimes handicapped person can move into or out of the passenger seat 22, the stairway chairlift 10, in accordance with one aspect of the invention, includes a swivel mechanism which permits the passenger seat 22 to pivot around a substantially vertical axis 50 from a first position, wherein the rear edge 30 of the seat 22 is substantially parallel to the stairway wall 14, to a second position wherein the rear edge 30 of the seat 22 is transverse to the wall 14. Preferably, the seat swivel mechanism allows the seat to be rotated through substantially 180° of arc from the second position, wherein the rear edge 30 of the seat 22 is substantially perpendicular to the wall 14, through the first position, as illustrated in FIG. 1, wherein the rear edge 30 of the seat 22 is substantially parallel to the stairway wall 14, to a third position wherein the rear edge 30 of the seat 22 is once again substantially perpendicular to the stairway wall 14. Preferably, the swivel seat mechanism further includes means for locking the passenger seat in any one of the first, second or third positions. In addition, means can be provided for locking the passenger seat in positions between the first, second and third positions.

In order to minimize the extent to which the passenger seat 22 extends outwardly from the stairway wall 14 and still provide rotation of the seat 22 between the first, second and third positions, the seat swivel mechanism is arranged so as to provide a substantially constant minimum clearance between the seat 22 and the stairway wall 14 as the seat rotates between the first, second and third positions. To this end, the seat swivel mechanism is arranged so that, as the seat moves from the first, or center position, wherein the rear edge 30 of the seat 22 is substantially parallel to the stairway wall 14, toward either of the second or third positions, the substantially vertical axis 50, around which the seat rotates, moves laterally outwardly from the stairway wall 14. As the seat 22 is rotated from either of the second or third positions back toward the center or first position, the vertical axis 50 around which the seat rotates moves laterally inwardly toward the wall 14. By maintaining a substantially constant minimum clearance between the seat 22 and the stairway wall 14 as the seat rotates, the rail 12 can be mounted closer to the wall 14 than in prior stairway chairlifts.

The construction and operation of the seat swivel mechanism can best be understood by reference to FIGS. 3 through 7. As illustrated, the internal framework of the seat includes a pair of substantially L-shaped side members 52 and 54 each formed of substantially square cross-sectioned steel channel or similar rigid material. Each of the side members includes a vertical portion 56, supporting the back portion 32 of the passenger seat 22, and a horizontally extending portion 58 supporting the horizontal portion 26 of the passenger seat. In addition, a generally horizontal, rectangular, rigid seat plate 60, formed of steel or similar durable material, is mounted between the forward ends of the horizontal portions 58 of the side members 52 and 54. A downwardly depending, generally cylindrical, pivot shaft 62, formed of steel or similar durable material, extends downwardly from the underside of the horizontal, rectangular seat plate 60 substantially midway between the horizontal portions 58 of the side members 52 and 54 and forms a pivot shaft defining the vertical axis 50 around which the seat 22 rotates.

As further illustrated, the seat swivel mechanism also includes a generally rectangular seat support or cross plate member 64, having downwardly turned edges 68 and 68, formed of a rigid durable material such as steel and positioned beneath the seat 22. Means are provided for supporting the cross plate 64 for movement toward and away from the wall 14 and preferably comprise a pair of drawer slide assemblies 70 and 72 mounted along the sides of the lower housing 20 adjacent the upper end thereof. The drawer slides 70 and 72 are commercially available units, and each drawer slide includes a first elongate channel 74 mounted to the upper end of the lower housing 20, a second elongate channel 76 supported by the first channel 74 and supporting one end of the cross plate 64, and a bearing mechanism between the first and second channels 74 and 76 for providing low friction sliding movement of the second channel 76 with respect of the first channel 74 toward and away from the stairway wall 14. An additional bearing member 78, having a cylindrical aperture 80 dimensioned to receive the downwardly depending pivot shaft 62 of the seat assembly 22, is mounted through the cross plate 64 substantially midway between the ends thereof and receives the pivot shaft 62 whereby the seat 22 is pivotable relative to the cross plate 64. Thus, with this arrangement, the seat 22 is mounted for pivoting movement relative to the cross plate 64, and the cross plate 64 is mounted to the lower housing 20 of the motorized chair unit 18 for lateral, horizontal movement toward and away from the stairway wall 14.

Figure 3:
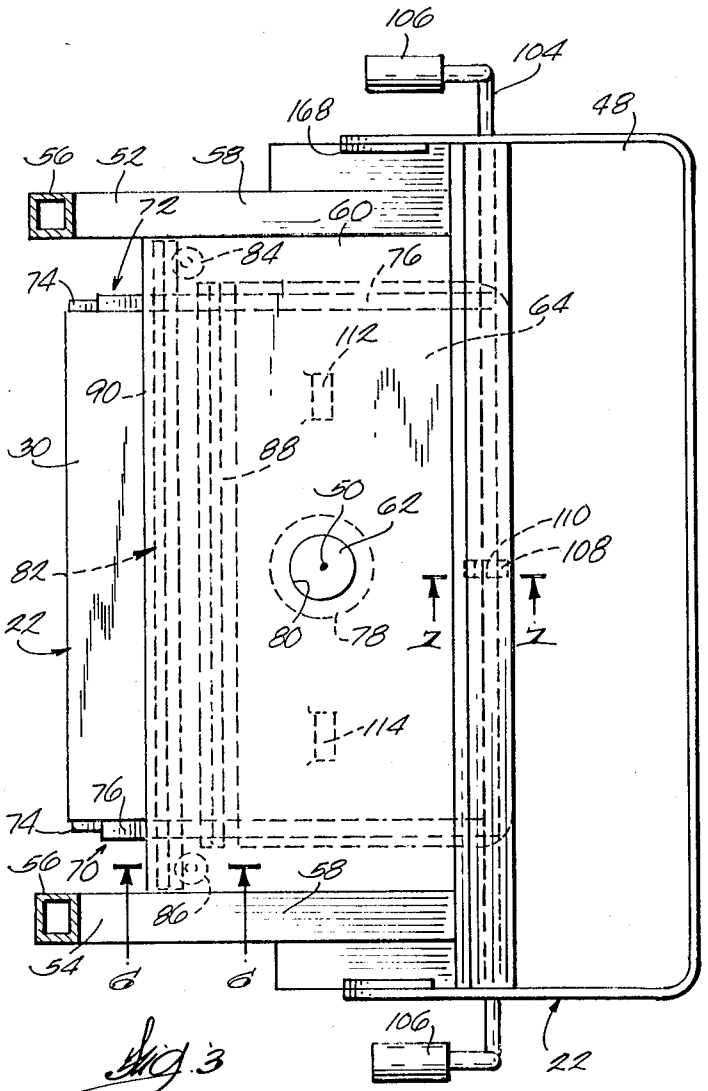
FIG. 3 is a top plan view of a chair unit included in the stairway chairlift system illustrated in FIGS. 1 and 2 showing a pivoting passenger seat in a non-rotated or center position.
Figures 6, 7, 8, 10:
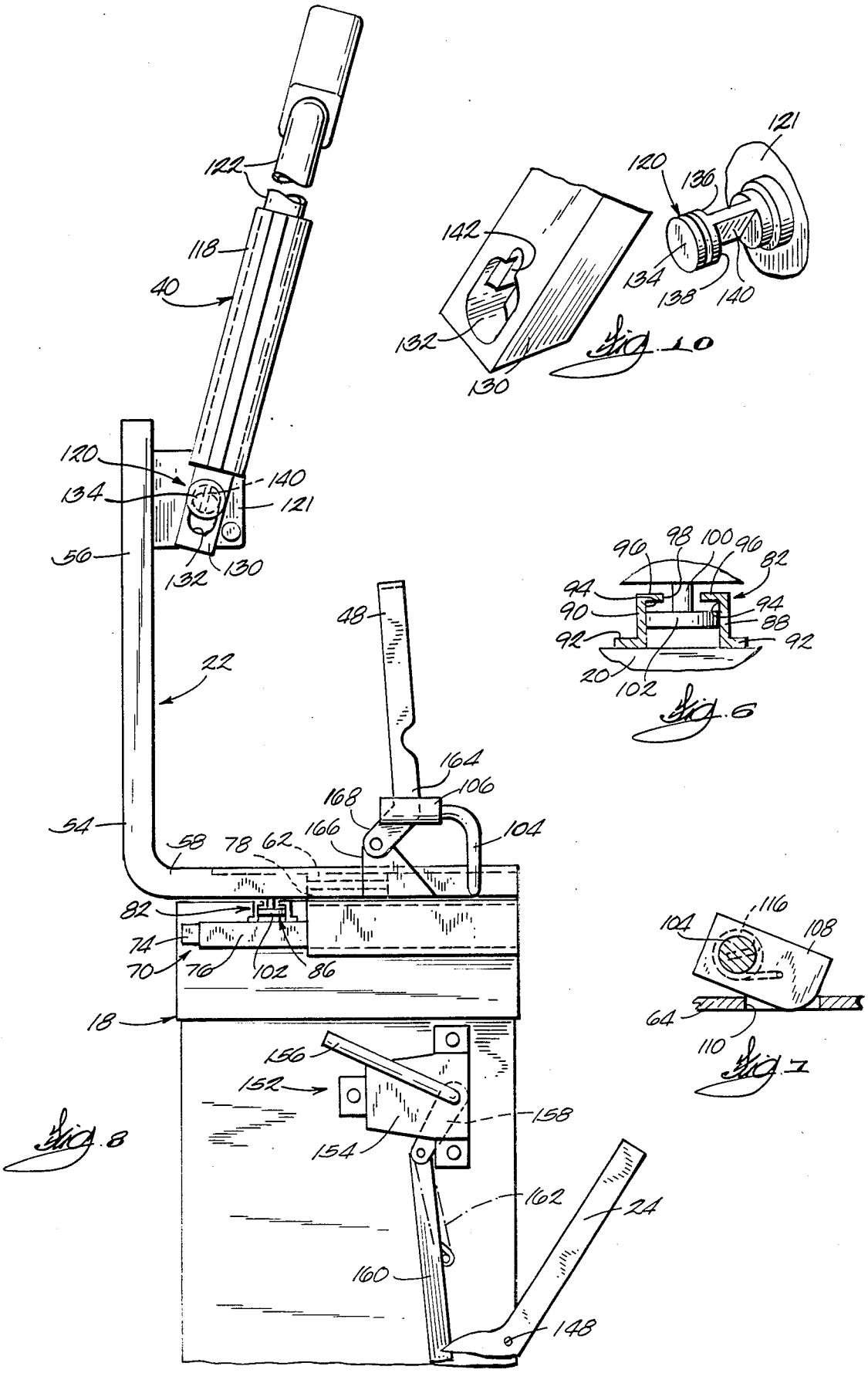
FIG. 6 is a fragmentary cross-sectional view of a portion of the chair unit illustrated in FIG. 3 taken along line 6—6 thereof.
FIG. 7 is a fragmentary cross-sectional view of a portion of the chair unit illustrated in FIG. 3 taken along line 7—7 thereof.
FIG. 8 is a fragmentary side-elevational view, similar to FIG. 5, showing the chair unit in a folded condition.
FIG. 10 is an exploded perspective view of a locking pivot mechanism for selectively providing pivoting movement of the passenger restraining arms.

To force the cross plate 64, and thus the substantially vertical rotational axis 50 of the seat 22, outwardly away from the stairway wall 14 when the seat 22 is rotated from the center position shown in FIG. 3, an elongate track 82 is fixedly mounted across the top of the lower housing 20 adjacent the rear edge of the housing 20, and a pair of downwardly depending followers 84 and 86, adapted to be received within and slideably movable along the track 82, are mounted to the undersides of each of the horizontal portions 58 of the two L-shaped side members 52 and 54 adjacent the rear corners thereof. The track 82 is preferably formed of a rigid, durable material such as steel, and comprises a pair of opposed, spaced, elongate forward and rearward flanges 88 and 90 having complementary cross-sectional shapes as shown in FIG. 6. Each of the flanges includes an outwardly extending lower horizontal portion 92 fixed to the top surface of the lower housing 20, a substantially vertical side portion 94 and an inwardly extending upper flange portion 96. The flange members are positioned so that a slot 98 is formed between the upper flange portions 96, and each of the followers 84 and 86 includes a downwardly depending stem portion 100 dimensioned to extend through the slot 98 thus formed. A relatively larger diameter lower follower portion 102, which is preferably journaled for rotation relative to the stem 100, is mounted to the lower end of each stem 100 and is adapted to ride along the channel formed between the vertical side portions 94 of the parallel flanges 88 and 90.

Figure 4:
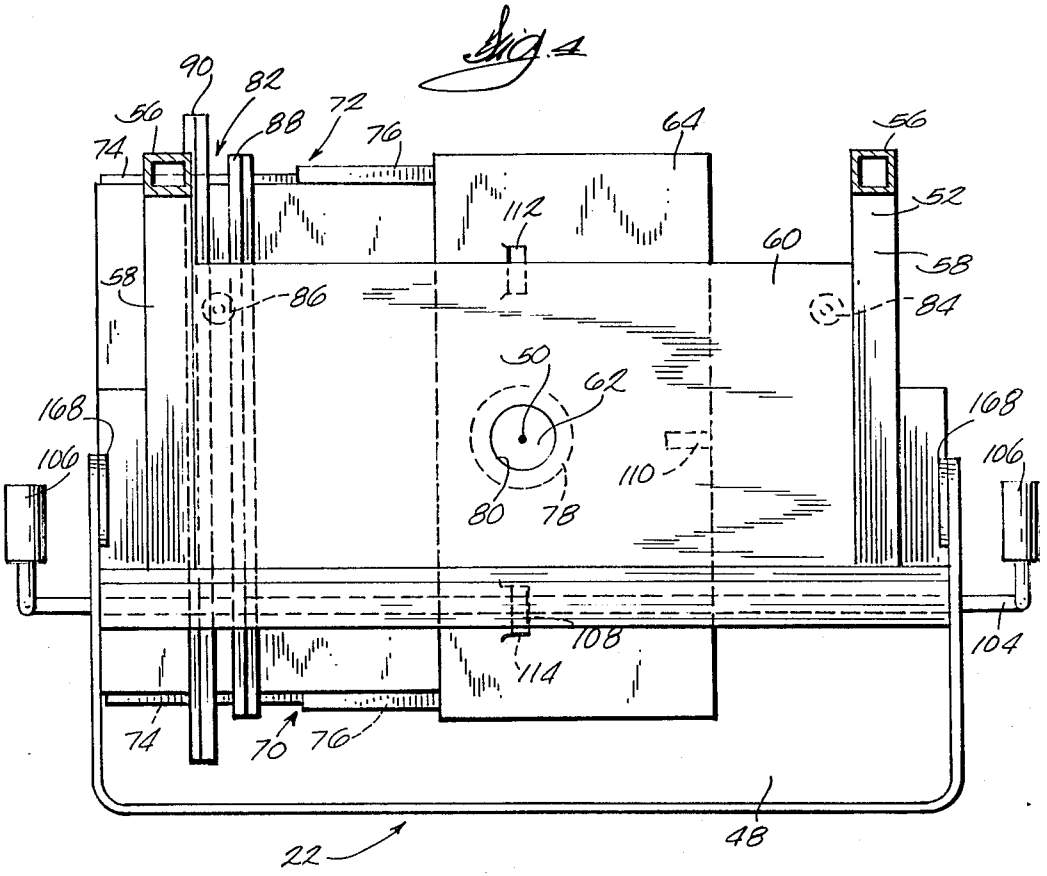
FIG. 4 is a top plan view, similar to FIG. 3 showing the pivoting passenger chair in a rotated and extended position.

As further illustrated in FIGS. 3 and 4, the rearward flange 90 of the track 82 is longer that the forward flange 88 so that the rearward flange 90 engages each of the followers 84 and 86 when the seat 22 is in the center position shown in FIG. 3 while the forward flange 88 does not. Thus, in the event the seat 22 is rotated, for example, in the clockwise direction as viewed in FIG. 3, one of the followers 86 will engage the rearward flange 90 of the track 82 and thus ride along the track 82 while the opposite follower 84 can move forwardly away from the track 82 and is not similarly confined. In the event the seat 22 is rotated in the counter-clockwise direction, the opposite follower 84 will engage the track 82 as the other follower 86 pivots free of the track 82. In this manner, one or the other of the followers 84 and 86 will be constrained for movement along the track 82 whenever the seat 22 is rotated from the center position illustrated in FIG. 3.

Because the distance between each of the followers 84 and 86 and the vertical axis 50 around which the seat 22 pivots is fixed, movement of either follower 84 or 86 from one end of the track 82 toward the center of the track 82 simultaneously forces the seat 82 and the cross plate 64 outwardly from the wall 14 as illustrated in FIG. 4. Similarly, when the seat 22 is rotated back toward the center position shown in FIG. 3, the seat 22 and the cross plate 64 are simultaneously pulled inwardly toward the wall 14. As a result, the minimum clearance between the seat 22 and the stairway wall 14 remains substantially unchanged regardless of the rotational position of the seat. Accordingly, the seat swivel mechanism provides a pivoting seat feature without substantially increasing the distance by which the seat 22 extends into the path of the stairway 16 when the stairway chairlift 10 is standing idle.

In order to provide a means for selectively locking the seat 22 in any of the first, second or third positions, an elongate pivotable shaft 104 is mounted along the underside of the seat 22 between the seat and the cross plate 64. Each end of the shaft 104 extends beyond the adjacent side edge of the seat 22 and includes a user-graspable handle portion 106 by means of which a passenger can manually rotate the shaft 104. An elongate metallic dog 108 s fixedly mounted adjacent the center of the shaft 104 for co-rotation with the shaft, and three elongate recesses 110, 112 and 114, dimensioned to receive the dog 108 are formed in the upper surface of the cross plate 64. The recesses 110, 112 and 114 are located as shown in FIGS. 3 and 4 and function to receive the dog 108, and thereby restrain further rotation of the seat, when the seat 22 is in any one of the first, second or third positions. Additional recesses (not shown) can be provided to permit the seat to be locked in positions other than the first, second and third positions. Preferably, a torsion spring 116 is mounted around the shaft 104 and functions to bias the shaft so as to drive the dog 108 toward the upper surface of the cross plate 64. By manually rotating the shaft 104, the passenger can rotate the dog 108 out of the adjacent recess and thereby permit rotation of the seat 22 toward one of the remaining positions.

Figure 9:
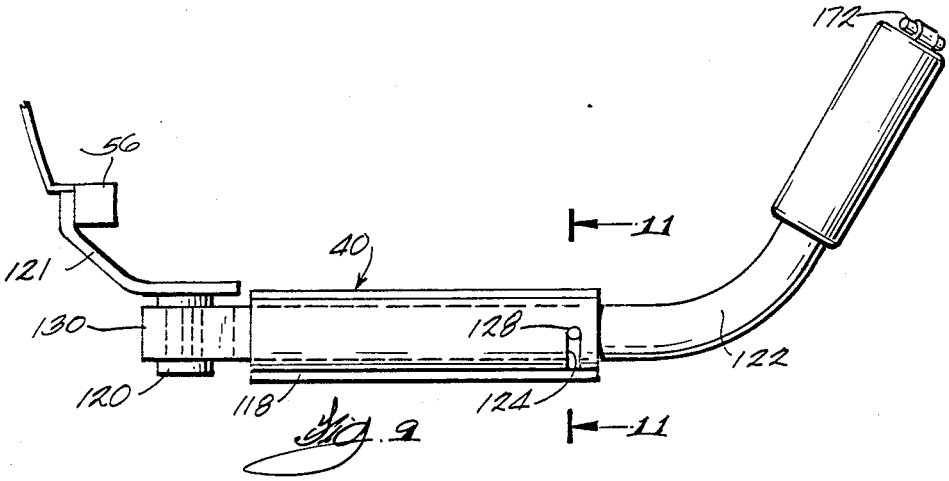
FIG. 9 is a top plan view of a pivoting passenger restraining arm included in the chair unit.

The construction of the passenger restraining arms 40 and 42 can best be understood by reference to FIGS. 5 and 8 through 11. As illustrated, each of the passenger restraining arms 40 and 42 includes an interior frame assembly generally comprising a pair of rigid, tubular, telescoping members formed of steel or similar durable material. The rear portion of each arm includes an outer tubular portion 118 mounted, at its rearward end, for pivoting movement around one of a pair of pivot shafts 120 extending outwardly from brackets 121 mounted to the vertical portions 56 of the L-shaped seat side members 52 and 54. An additional, inner tubular member 122 is received within the interior of the rearward or outer tubular member 118 and is rotatable around the linear axis defined by the rearward member 118. The inner tubular member 122 is dimensioned to extend beyond the forward end of the rear member 118 and is bent, as best illustrated in FIG. 9, so as to form an inwardly directed barrier or passive restraint around the seat 22. Preferably, a pair of diametrically opposed, circumferentially extending slots 124 and 126 are formed through the rearward tubular member 118 adjacent the forward end thereof, and a cylindrical pin 128 extends diametrically through the forward tubular member 122 and within the diametrically opposed slots 124 and 126 so as to resist lateral movement of the tubular members 118 and 122 relative to one another and so as to confine the tubular members for rotation through substantially 90° of arc relative to one another.

The mechanism for pivotally attaching each of the arms 40 and 42 to the back portion 32 of the seat 22 can best be understood by reference to FIGS. 5, and 8 through 10. As illustrated, the rearward end of each rearward outer tube 118 includes a metallic extension 130 of substantially rectangular cross-section. An aperture 132, for receiving the horizontally extending pivot shaft 120, is formed through the extension 130, and a head portion 134, of greater diameter than the aperture 132, is formed at the outermost end of each pivot shaft 120 to prevent the extension 130 from sliding over the end of the shaft 120. As best seen in FIG. 10, the pivot shaft 120 is provided with a pair of diametrically opposed transverse grooves or flats 136 and 138 which give the pivot shaft 120 a substantially elongate, rectangular cross-section along a portion 140 of its length between its ends. In addition, the extension 130 is provided with a slot 142, dimensioned to receive the narrowed or flat portion 140 of the pivot shaft 120, extending from the central aperture 132 in a direction toward the outermost end of the arm 40 or 42. The pivot shaft 120 is positioned so that, when the passenger arm 40 or 42 is raised to the position shown in FIG. 8, the arm can slide downwardly so that the narrowed portion 140 of the pivot shaft 120 is received within the slot 142 formed in the extension 130. When thus received, further rotation of the passenger arm relative to the pivot shaft 120 is resisted and the arm can thus provide a rigid, upright support which can then be used by a passenger to facilitate movement onto or off of the seat 22. Such a support is of particular value to disabled passengers, such as those in wheelchairs, who lack the use of their legs and must rely on their arms to move themselves onto and off of the seat. Following such movement, the raised passenger restraining arm 40 or 42 can be lifted upwardly to free the narrowed portion 140 from the slot 142 after which the arm can be rotated to the lowered position shown in FIG. 5. Preferably, all sides of the arm 40 and 42, including the undersides, are padded so that a padded surface faces the passenger regardless of the position of the arm.

The mechanism for raising and lowering the foot rest 24 is best illustrated in FIGS. 1, 2, 5 and 8. As therein illustrated, the foot rest 24 comprises a generally rectangular, planar member, formed of steel or similar rigid material, having upwardly turned side edges 144 and 146. The rearmost edge of the foot rest 24 is adapted to extend along the front and partially along the sides of the lower housing 20, and a pair of opposed pivot pins 148 extend through the sides of the foot rest 24 to pivotally join the foot rest 24 to the lower housing 20. In addition, a rearwardly directed extension 150 is formed at the rearmost edge on one side 144 of the foot rest 24 and functions to provide a lever arm through which torque can be applied and thereby cause the foot rest 24 to rotate around the pivot pins 148.

Torque for raising and lowering the foot rest 24 is developed by means of a user-actuable lever mechanism 152 mounted along one side of the lower housing 20 and positioned so as to be easily grasped by the passenger. As illustrated, the lever mechanism includes a bracket 154 affixed to the side of the lower housing 20 and a user-graspable handle 156 pivotally mounted to the bracket 154. The handle 156 is mounted for rotation around a generally horizontal axis and includes an upwardly and rearwardly extending arm 158 located between the bracket 154 and the side of the lower housing 20. A rigid linkage member 160 is pivotally mounted between the ends of the handle arm 158 and the foot rest extension arm 150 and functions to translate rotation of the user-actuable handle 156 into rotation of the foot rest 24 around the pivot pins.

Figure 5:
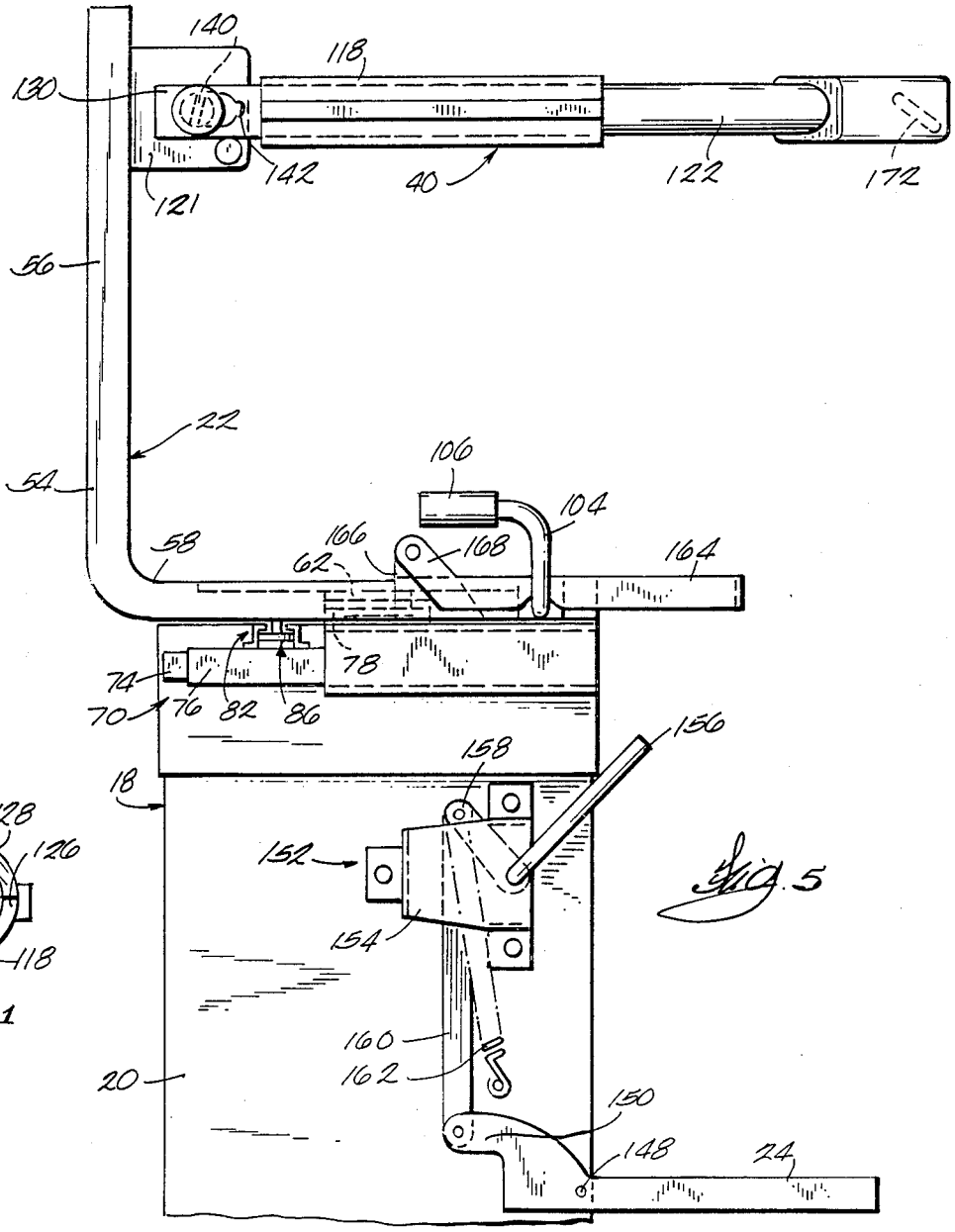
FIG. 5 is a fragmentary side-elevational view of the chair unit illustrated in FIGS. 3 and 4 shown in an unfolded condition.
Figure 11:
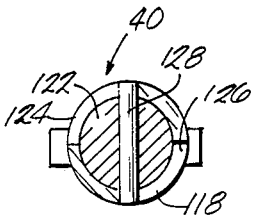
FIG. 11 is a cross-sectional view of the passenger restraining arm illustrated in FIG. 9 taken along line 11—11 thereof.

In the embodiment illustrated in FIGS. 5 and 8, rotation of the handle 156 in the counter-clockwise direction causes the foot rest 24 to rotate toward the raised position, while forward or clockwise movement of the handle 156 causes the foot rest 24 to be lowered. To reduce the force necessary for raising and lowering the foot rest 24, the actuating mechanism preferably includes a bias spring 162 coupled between the lower housing 20 and the end of the handle lever arm 158 so as to bias the foot rest 24 toward the raised position. By selecting a spring of suitable strength, the user-applied force necessary to raise the foot rest 24 can be considerably reduced.

A particular advantage of the user-actuable lever mechanism is that the foot rest can be raised or lowered while the seat 22 is in the horizontal position. This helps avoid interference, by the foot rest, with a passenger's movement between the seat and a wheelchair.

As further illustrated in FIGS. 5 and 8, the internal frame of the passenger seat includes a pair of forward extensions 164 which pivotally support the forward horizontal portion 48 of the seat 22. Each of the forward extensions 164 comprises a length of rigid channel, formed of steel or similar durable material, and is pivotally mounted at its rearward end to the forward end of the horizontal portion 58 of the adjacent L-shaped side member. In the embodiment illustrated, the forward end of each of the horizontal portions of the L-shaped side members 52 and 54 includes an upward extension 166, and the rearward end of each of the forward extension members 164 includes an upwardly and rearwardly directed extension 168 which is pivotally joined to the end of the upward extension 166. This arrangement allows the forward horizontal portion 48 of the seat 22 to extend upwardly and away from the remainder of the seat 22 when the forward portion 48 is rotated to the raised position shown in FIGS. 2 and 8.

To facilitate convenient passenger operation, ergonomically advantageous, user-actuable control switches 170, for controlling operation of the stairway chairlift 10, are preferably positioned along the outer edge of one of the arms 42 adjacent the outer end thereof. When so positioned, such switches 170, which can control such functions as start/stop and direction of travel, fall where they can be easily manipulated by a passenger sitting in the passenger seat 22. In one embodiment of the invention, operation of the stairway chairlift 10 is inhibited when the arms 40 and 42 are positioned other than in the lowered position shown in solid lines in FIG. 1. To this end, a mercury switch 172 is mounted to the outermost end of each arm 40 and 42 as illustrated in FIGS. 5 and 9 and is electrically coupled to the motor within the lower housing 20 so as to inhibit motor operation when the arms 40 and 42 are other than in the lowered position. Preferably, additional switches, responsive to the rotational position of the chair 22 around the vertical rotational axis 50, are arranged to inhibit chairlift operation when the chair 22 is rotated to a position other than the center position shown in FIG. 1. Still further switches can be provided for inhibiting stairway chairlift operation when the foot rest 24 and the forward horizontal portion 58 of the seat 22 are other than in the lowered position shown in FIG. 1.

While a particular embodiment of the invention has been shown and described, it will be obvious to those skilled in the art that changes and modifications may be made therein without departing from the invention in its broader aspects, and, therefore, the aim in the appended claims is to cover all such changes and modifications as fall within the true spirit and scope of the invention.

We claim:

1. A stairway chairlift comprising:

a motorized chair unit movable along a wall of a stairway;

a seat having a rearward edge portion;

means for pivotably mounting said seat to said motorized chair unit for pivoting movement around a substantially vertical axis between a first position wherein said rearward edge portion of said seat is positioned adjacent and substantially parallel to the stairway wall, and a second position wherein said rearward edge portion of said seat is positioned substantially transverse to the stairway wall; and means responsive to pivoting movement of said seat around said substantially vertical axis for moving said seat outwardly away from the stairway wall in response to pivoting movement of said seat from said first position to said second position and for moving said seat inwardly toward the stairway wall in response to pivoting movement of said seat from said second position to said first position, said means for moving said seat outwardly including an elongated guide mounted on said motorized chair unit, said elongated guide being substantially parallel to the stairway wall, and a follower which is mounted to said rearward edge of said seat and which travels along said guide as said seat rotates between said first and said second positions.

2. A stairway chairlift in accordance with claim 1 wherein said means responsive to pivoting movement of said seat moves said seat outwardly and inwardly relative to the stairway wall so as to maintain a substantially constant minimum distance between said seat and the stairway wall as said seat rotates between said first and second positions.

3. A stairway chairlift in accordance with claim 2 wherein said seat includes a pair of corners at opposite ends of said rearward edge portion and wherein said follower is mounted on one of said corners.

4. A stairway chairlift comprising:

a chair unit which is movable along a wall;

a seat having a rear edge;

a seat support positioned beneath said seat and supporting the seat;

means supported by said seat support for supporting said seat for rotation around a vertical axis with respect to said seat support from a first position wherein the rear edge of said seat is substantially parallel to the wall, to a second position wherein said rear edge of said seat is transverse to the wall;

means for supporting said seat support for movement toward and away from the wall; and an elongated guide mounted on said means for supporting said seat support, said elongated guide being substantially parallel to the stairway wall, and a follower which is mounted to said rearward edge of said seat and which travels along said guide as said seat rotates between said first and second positions.

5. A stairway chairlift in accordance with claim 4 wherein said chair unit includes a frame and wherein said means for supporting said seat support for movement away from the wall includes a first channel supported by said frame and having a longitudinal axis extending away from the wall, a second channel supported by said first channel and supporting said seat support, and bearing means between said second channel and said first channel for providing low friction sliding movement of said second channel with respect to said first channel toward and away from the wall.

6. A stairway chairlift in accordance with claim 5 wherein said seat support comprises a cross plate positioned horizontally beneath said seat.

7. A stairway chairlift in accordance with claim 6 wherein said means for supporting said seat support for movement away from the wall includes a drawer slide.

8. A stairway chairlift in accordance with claim 4 wherein said means for supporting said seat for rotation around a vertical axis further provides rotation of said seat around said vertical axis to a third position oriented substantially 180° from said second position around said vertical axis.

9. A stairway chairlift in accordance with claim 8 further comprising means for releasably locking said seat against rotation relative to said seat support.

10. A stairway chairlift in accordance with claim 9 wherein said means for releasably locking said seat locks said seat in said first, second or third positions.

11. A stairway chairlift in accordance with claim 10 wherein said seat support comprises a cross plate positioned horizontally beneath said seat and wherein said means for releasably locking includes a substantially horizontal, rotatable shaft positioned between said cross plate and said seat, a plurality of recesses formed substantially vertically in said cross plate, and a dog carried on and movable with said shaft and receivable in one of said recesses when said seat is in one of said first, second or third positions.

12. A seat swivel mechanism for stairway chairlifts of the type including a motorized chair unit movable along a wall of a stairway, said seat mechanism comprising:

a seat having a rearward edge portion, and a pair of corners at opposite ends of said rearward edge portion;

means for pivotably mounting said seat to the motorized chair unit for pivoting movement around a substantially vertical axis between a first position wherein said rearward edge portion of said seat is positioned adjacent and substantially parallel to the stairway wall, and a second position wherein said rearward edge portion of said seat is positioned substantially transverse to the stairway wall;

means responsive to pivoting movement of said seat around said substantially vertical axis for moving said seat outwardly away from the stairway wall in response to pivoting movement of said seat from said first position to said second position and for moving said seat inwardly toward the stairway wall in response to pivoting movement of said seat from said second position to said first position, and including means for confining one of said corners for movement along a substantially horizontal path extending substantially parallel to the stairway wall as said seat is rotated between said first and second positions, so as to maintain a substantially constant minimum distance between said seat and the stairway wall as said seat rotates between said first and second positions.

13. A seat swivel mechanism in accordance with claim 12 wherein said means for confining one of said corners comprises an elongate guide mounted on the motorized chair unit substantially parallel to the stairway wall and further comprising a follower mounted to said seat adjacent said corner and adapted to travel along said guide as said seat rotates between said first and second positions.

14. A seat mechanism for a stairway chairlift including a chair unit including a frame and adapted to be movable along a wall, said seat mechanism comprising:

a seat having a rear edge;

a seat support positioned beneath said seat and supporting the seat;

means supported by said seat support for supporting said seat for rotation around a vertical axis with respect to said seat support from a first position wherein the rear edge of said seat is substantially parallel to the wall, to a second position wherein said rear edge of said seat is transverse to the wall;

means for supporting said seat support for movement toward and away from the wall;

means for moving said seat support and said seat away from the wall in response to rotation of said seat from said first position toward said second position and including a first channel supported by the frame and having a longitudinal axis extending away from the wall, a second channel supported by said first channel and supporting said seat support, and bearing means between said second channel and said first channel for providing low friction sliding movement of said second channel with respect to said first channel toward and away from the wall.

15. A seat mechanism in accordance with claim 14 wherein said means for moving said seat support and said seat away from the wall in response to rotation of said seat from said first position toward said second position includes a follower means secured to one of said seat and the frame and further includes a guide track secured to the other of said seat and the frame, said guide track extending generally parallel to the wall and being adapted to house said follower means during rotation of said seat from said first position to said second position.

16. A seat mechanism in accordance with claim 14 wherein said seat support comprises a cross plate positioned horizontally beneath said seat.

17. A seat mechanism in accordance with claim 16 wherein said means for supporting said cross plate and said seat for movement away from the wall includes a drawer slide.

18. A seat swivel mechanism for a chair including a base adapted to be mounted proximate a wall, said seat mechanism comprising:

a seat having a rearward edge portion, and a pair of corners at opposite ends of said rearward edge portion;

means for pivotably mounting said seat to the base for pivoting movement around a substantially vertical axis between a first position wherein said rearward edge portion of said seat is positioned adjacent and substantially parallel to the wall, and a second position wherein said rearward edge portion of said seat is positioned substantially transverse to the wall; and means responsive to pivoting movement of said seat around said substantially vertical axis for moving said seat outwardly away from the stairway wall in response to pivoting movement of said seat from said first position to said second position and for moving said seat inwardly toward the stairway wall in response to pivoting movement of said seat from said second position to said first position, and including means for confining one of said corners for movement along a substantially horizontal path extending substantially parallel to the wall as said seat is rotated between said first and second positions, so as to maintain a substantially constant minimum distance between said seat and the wall as said seat rotates between said first and second positions.

19. A seat swivel mechanism in accordance with claim 18 wherein said means for confining one of said corners comprises an elongate guide mounted on the base substantially parallel to the stairway wall and further comprises a follower mounted to said seat adjacent said corner and adapted to travel along said guide as said seat rotates between said first and second positions.

20. A seat mechanism for a chair including a frame adapted to be mounted proximate a wall, said seat mechanism comprising:

a seat having a rear edge;

a seat support positioned beneath said seat and supporting the seat;

means supported by said seat support for supporting said seat for rotation around a vertical axis with respect to said seat support from a first position wherein the rear edge of said seat is substantially parallel to the wall, to a second position wherein said rear edge of said seat is transverse to the wall;

means for supporting said seat support for movement toward and away from the wall;

means for moving said seat support and said seat away from the wall in response to rotation of said seat from said first position toward said second position and including a first channel supported by the frame and having a longitudinal axis extending away from the wall, a second channel supported by said first channel and supporting said seat support, and bearing means between said second channel and said first channel for providing low friction sliding movement of said second channel with respect to said first channel toward and away from the wall.

21. A seat mechanism in accordance with claim 20 wherein said means for moving said seat support and said seat away from the wall in response to rotation of said seat from said first position toward said second position includes a follower means secured to one of said seat and the frame and further includes a guide track secured to the other of said seat and the frame, said guide track extending generally parallel to the wall and being adapted to house said follower means during rotation of said seat from said first position to said second position.

22. A seat mechanism in accordance with claim 20 wherein said seat support comprises a cross plate positioned horizontally beneath said seat.

23. A seat mechanism in accordance with claim 22 wherein said means for supporting said cross plate and said seat for movement away from the wall includes a drawer slide.

* * * * *